US008454144B2

(12) United States Patent
Platt et al.

(10) Patent No.: US 8,454,144 B2
(45) Date of Patent: Jun. 4, 2013

(54) INK STORAGE RESERVOIR FOR A SOLID INK PRINTHEAD

(75) Inventors: David Paul Platt, Newberg, OR (US); Michael Edward Norkitis, Newberg, OR (US); William Bruce Weaver, Canby, OR (US)

(73) Assignee: Xerox Corporation, Norwalk, CT (US)

( * ) Notice: Subject to any disclaimer, the term of this patent is extended or adjusted under 35 U.S.C. 154(b) by 6 days.

(21) Appl. No.: 12/684,183

(22) Filed: Jan. 8, 2010

(65) Prior Publication Data

US 2011/0169883 A1 Jul. 14, 2011

(51) Int. Cl.
*B41J 2/175* (2006.01)

(52) U.S. Cl.
USPC ..... 347/87; 347/85; 347/7

(58) Field of Classification Search
USPC ..... 347/7, 19, 86, 85, 87, 5
See application file for complete search history.

(56) References Cited

U.S. PATENT DOCUMENTS 5,781,212 A 7/1998 Burr et al.
5,870,124 A 2/1999 Silverbrook
6,247,807 B1 * 6/2001 Yang et al. ..... 347/87
6,260,963 B1 7/2001 Reistad et al.
6,773,099 B2 * 8/2004 Inoue et al. ..... 347/86
7,144,100 B2 12/2006 Hill et al.
7,300,143 B2 11/2007 Slotto et al.
7,360,876 B2 * 4/2008 Inoue et al. ..... 347/85
7,524,044 B2 * 4/2009 Kumagai ..... 347/85
7,600,863 B2 10/2009 Brick et al.
2008/0231650 A1 * 9/2008 Kojima et al. ..... 347/17
2009/0079804 A1 * 3/2009 Kimura ..... 347/86

* cited by examiner

*Primary Examiner* — Lam S Nguyen
(74) *Attorney, Agent, or Firm* — Maginot, Moore & Beck, LLP

(57) ABSTRACT

A reservoir is provided for a printhead in an ink jet printing machine, the printhead having at least one printhead inlet at a rear face thereof for flow of ink from the reservoir into the printhead. The reservoir comprises a perimeter wall sealably mounted to the rear face of the printhead and defining a chamber in communication with the printhead inlet. The chamber is open at one face and the reservoir includes a resilient flexible membrane attached to the perimeter wall and covering the one face. An inlet is provided in communication with the chamber for passage of ink into the chamber. The resilient flexible membrane has an initial relaxed condition in a first state in which the reservoir is substantially full of ink, and a flexed condition in which the membrane is collapsed into the chamber.

7 Claims, 3 Drawing Sheets

INK STORAGE RESERVOIR FOR A SOLID INK PRINTHEAD

BACKGROUND

The present disclosure relates to devices and machines for printing and more particularly to the printheads and the ink supply to the printhead in such devices or machines.

As shown in FIG. 1, one type of printing machine 10 utilizes a printhead 12 that is operable to apply droplets of liquid ink onto a substrate 14 conveyed by a media transport mechanism 16. In some machines, the ink is applied directly to the substrate, as depicted in FIG. 1, while in other machines the ink is applied to a transfer element, such as a transfer drum, which then transfers the printed image onto the substrate.

The printhead 12 receives a supply of liquid ink from a remote reservoir 18. In certain machines, the ink from the remote reservoir 18 is fed under pressure to the printhead. Thus, the machine 10 may include a pressure source 20, such as a compressed air source, that is connected through a pressure valve assembly 22 to the remote reservoir 18. An output valve assembly 24 controls the flow of ink from the remote reservoir through fluid line 26 to a local reservoir 28 directly associated with the printhead 12. When ink is in the local reservoir 28, pressure from air line 30 through pressure valve assembly 22 may be applied to force the ink from the local reservoir into the printhead 12. A controller 32 controls the timing and operation of these valve assemblies, media transport mechanism and printhead of the machine 10, as is known in the art.

The printhead 12 may be configured to apply multiple colors of ink to the substrate 14. Thus, the remote and local reservoirs 18, 28 each include a plurality of separate reservoirs, one for each color of ink. The ink is typically provided in four colors—black, yellow, cyan and magenta—so that four separate reservoirs may be provided. The reservoirs may supply ink to a single printhead, or to a corresponding one of a plurality of printheads. The pressure valve assembly 22 and output valve assembly 24 will each include four valves, along with four corresponding fluid lines 26 and air lines 30. Each of the valves is individually controllable by the controller 32 to provide a multi-color printing capability at the printhead or printheads 12.

In a typical machine 10, a printhead 12 is formed by a stack of plates that define the ink flowpath through a series of manifolds between each of the local reservoirs 28 and a plurality of inkjet nozzles. The printhead stack may further include heating plates, filters and an ink discharge or diaphragm plate that is operable to eject ink through the nozzles. Pressure considerations have dictated the construction of the printhead 12 and local reservoir 28 to ensure proper printhead function. For instance, it is preferable that a slight negative pressure exist at the inkjet nozzles for the most robust or optimum ejection of ink through the nozzles. Positive pressure applied at the inkjet nozzles during printing has been found to cause nozzle failure.

In order to avoid these pressure-related problems, the local reservoir of a typical machine 10 is typically formed as a cast metal (often aluminum) tank. The reservoir in these prior devices is sized large enough (taking into account machining tolerances and tilt angles of the reservoir) so that the usable ink volume contained within the reservoir remains below the lowest row of inkjet nozzles in the printhead 12. While this approach ensures that the inkjet nozzles have a slight negative pressure during printing, it comes at a cost of higher steady-state power loss, longer warm-up times for ink contained within the large reservoir, higher material costs in manufacturing the reservoir and greater printhead weight. In addition, in this prior approach the local reservoir tank is an open system, which requires consideration of venting and ink spillage.

There is a need for a device and method for supplying ink to the printhead that meets the pressure requirements for the printhead without the costs and size associated with prior local reservoir tanks.

SUMMARY

According to aspects disclosed herein, there is provided a reservoir for a printhead in an ink jet printing machine, the printhead having at least one printhead inlet at a rear face thereof for flow of ink from the reservoir into the printhead. The reservoir comprises a perimeter wall sealably mounted to the rear face of the printhead and defining a chamber in communication with the printhead inlet. The chamber is open at one face and the reservoir includes a resilient flexible membrane attached to the perimeter wall and covering the one face. An inlet is provided in communication with the chamber for passage of ink into the chamber. The resilient flexible membrane has an initial relaxed condition in a first state in which the reservoir is substantially full of ink, and a flexed condition in which the membrane is collapsed into the chamber.

In another aspect, a printhead assembly comprises a printhead including a nozzle for discharge of liquid ink, a conduit in communication with the nozzle and a reservoir. The reservoir includes a perimeter wall sealably mounted to the printhead and defining a chamber in communication with the conduit and open at one face, a resilient flexible membrane attached to the perimeter wall and covering the one face, and an inlet in communication with the chamber for passage of ink into the chamber.

In yet another aspect, a printhead assembly is provided comprising a printhead including a nozzle for discharge of liquid ink, a conduit in communication with the nozzle, a reservoir formed by a resilient flexible membrane attached to the printhead and defining a chamber in communication with the conduit, and an inlet in communication with the chamber for passage of ink into the chamber.

DETAILED DESCRIPTION

Figure 1:
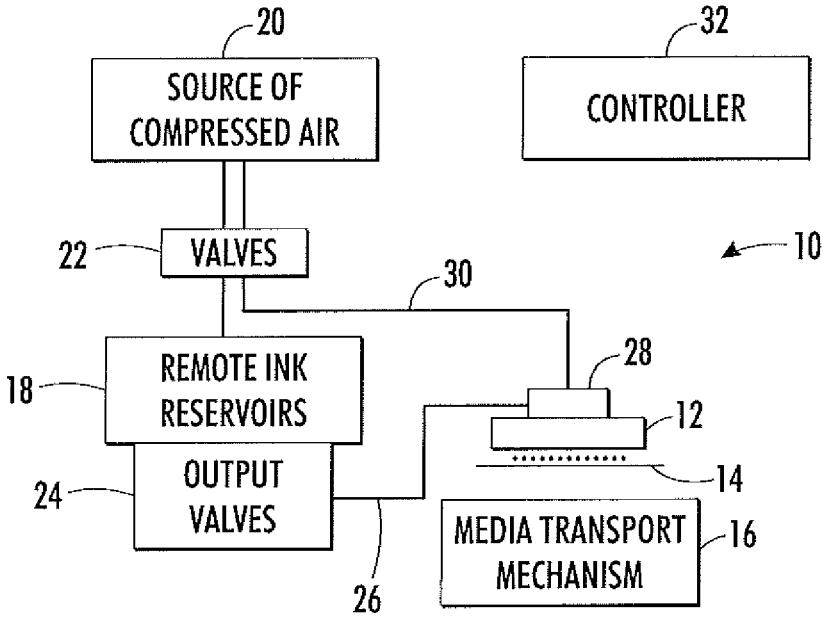
FIG. 1 is a schematic block diagram of a printing machine that includes a local reservoir directly associated with the printhead.
Figure 2A:
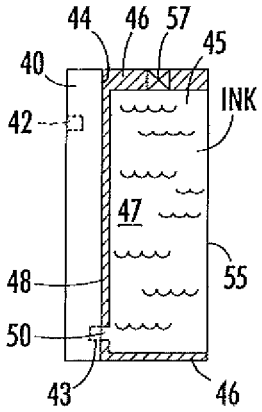
FIG. 2*a* is a side partial cross-sectional view of a local reservoir according to the present disclosure mounted to a printhead, with the reservoir shown in an initial state.
Figure 2B:
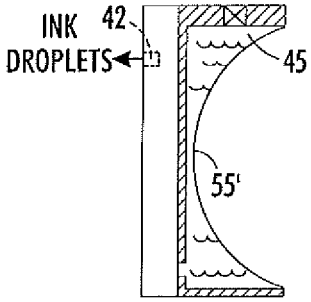
FIG. 2*b* is a side partial cross-sectional view of the local reservoir depicted in FIG. 2*a*, shown in a printing state.
Figure 2C:
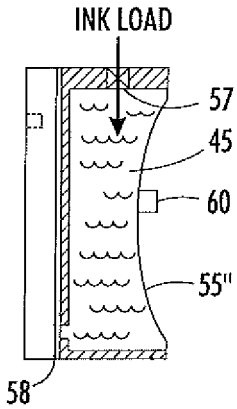
FIG. 2*c* is a side partial cross-sectional view of the local reservoir depicted in FIG. 2*a*, shown in an ink loading state.

Referring to FIGS. 2*a-c*, an inkjet printhead stack 40 is provided with a local reservoir 45 directly associated with the printhead. The printhead 42 includes an array of inkjet nozzles 42 and may be otherwise constructed as is known in the art for ejecting ink droplets onto a substrate. The local reservoir 45 includes side or perimeter walls 46 and a mating wall 48 that is configured for fluid-tight engagement to the printhead 40. The mating wall 48 defines an outlet 50 for supplying ink to the printhead 40 and particularly to the inkjet nozzles 42. A plurality of outlet openings 50 may be provided corresponding to the number of colors of ink being supplied to the printhead. The inkjet stack is configured with an inlet opening(s) 43 at the rear face 44 that corresponds to the outlet(s) 50 in the local reservoir mating wall 48. A one-way valve or check valve may be incorporated into any of these openings to permit one-way flow into the printhead.

The reservoir 45 may be mounted on or affixed to the rear face 44 of the printhead in a conventional manner. For instance, the mating wall 48 may be bonded to the rear face 44 or fastened with screws. It is understood that the mating wall 48 may be eliminated in favor of sealably mounting the perimeter walls 46 directly to the printhead 40 with the inlet opening(s) 43 of the printhead in direct communication with the chamber 47 of the reservoir(s). In this case, the edges of the perimeter walls 46 may be bonded to the rear face 44 or affixed in some other way capable of providing a fluid-tight seal.

In one embodiment, at least one one-way inlet 57 is defined in at least one of the perimeter walls 46. The inlet 57 may incorporate a check valve or similar valve that is operable to permit flow of ink into but not out of the reservoir 45. The inlet 57 is connected to an external ink supply, such as the remote ink reservoirs 18 of the printing machine 10. Alternatively, the inlet 57 may incorporate a valve that is controlled by the controller 32 to open when ink is being fed to the reservoir and closed during printing. The inlet 57 may be defined in the mating wall 48 while the jet stack of the printhead defines an appropriate conduit to connect the inlet to the remote ink reservoir. (The conduit may be configured like the conduit 76 shown in FIG. 4 described in more detail herein).

The local reservoir 45 may be a cast metal (such as aluminum), plastic or formed sheet metal tank, as is known in the art, but having a much abbreviated depth relative to prior reservoir tank designs. In one embodiment, the local reservoir has a depth of 0.1 inches, which is approximately the thickness of the jet stack of the printhead 40. (It is noted that the relative dimensions of the printhead and local reservoir are exaggerated in FIGS. 2*a-c* for clarity). The inlet 57 and outlet 50 may be cast, machined or etched into the walls of the reservoir.

The perimeter walls 46, together with a mating wall 48, if present, or with the rear face 44 of the printhead, define a chamber 47 that is open at one face, as shown in FIG. 2*a*. In one aspect, the local reservoir 45 includes solid walls on only the perimeter walls 46 and the optional mating wall 48. The open face of the chamber is closed by a resilient and flexible membrane or diaphragm 55. In one embodiment, the membrane 55 is a thin silicone sheet that is bonded to the perimeter walls 46. The silicone sheet may have a thickness of about 10 mils. Other compliant materials and thicknesses may be used, such as a 1 mil thick polyimide (PI), PET or PEEK film. In an initial state depicted in FIG. 2*a*, the reservoir 45 is full of ink and the one-way inlet 57 is closed to both additional ink and to external pressure. In this initial state, the membrane is essentially in its relaxed or neutral condition so that the membrane does not exert any pressure against the ink within the reservoir. As can be seen in FIG. 2*a*, when the reservoir is full the ink level may be above the printhead nozzles 42. Since the entire system is closed there is no risk of spillage regardless of whether the printhead and reservoir are tilted from vertical.

With the reservoir fully charged the printhead is ready for a printing operation. Ink is drawn from the reservoir 45 to feed the inkjet nozzles 42 of the printhead. The inlet valve 57 remains closed during this operation, as shown in FIG. 2*b*, so that a negative pressure is behind the inkjet nozzles and within the local reservoir 45. As the ink is drawn by negative pressure from the reservoir 45, the membrane flexes or collapses inward to its printing state 55'. The membrane is sufficiently compliant to substantially hug the interior of the reservoir 45 so that the reservoir is nearly emptied when the printing operation is complete.

Once the reservoir 45 has been emptied, the controller 32 directs additional molten ink under pressure through the inlet 57 to re-fill the reservoir, as shown in FIG. 2*c*. As the negative pressure is removed, the membrane resiliently flexes outward to state 55" from its flexed state 55', assisted by the influx of new ink into the reservoir. The flexible membrane thus absorbs the pressure of the new ink load, thereby preventing the exposure of the inkjet nozzles 42 to positive pressure. The membrane ensures that the volume behind the membrane is always full of ink and that there is no air pocket within the reservoir 45. It is understood that when the full ink load has been dispensed into the reservoir, the membrane is in the state 55 shown in FIG. 2(*a*).

It can be appreciated that the membrane 55 allows the local reservoir 45 to remain a closed system. Since the reservoir is not vented to atmosphere there is almost no risk of air bubble entrained within the ink, and therefore no need to purge air bubbles from the reservoir prior to a printing operation. In addition, the closed system nature of the reservoir eliminates the head height restrictions of prior local reservoirs. The membrane allows virtually all of the ink to be drawn from the reservoir, which allows the reservoir 45 to be smaller than conventional printhead reservoirs. In addition, the compliant membrane may help negate or minimize the effect on inkjetting performance of ink being delivered under pressure from the remote reservoir. Under certain conditions, the membrane 55 may expand outward from the reservoir 47 in response to the ink delivery pressure to avoid any increase in ink pressure prior to passage into the printhead 40.

The membrane 55 may be augmented to maintain an acceptable negative pressure as the ink is supplied to the printhead for jetting. Thus, a negative pressure control may include an element for applying an outward force (i.e., away from the chamber 47) on the back side or outside of the compliant membrane that provides a calibrated force resisting the inward deflection of the membrane from the state in FIG. 2(*a*) to the state in FIG. 2(*b*). For example, the element may include a tension spring sealably attached to the center of the spring, such as at the location designated 60 in FIG. 2(*c*), or alternatively a closed vacuum chamber mounted to the reservoir 45.

The smaller reservoir reduces the ink volume, which decreases warm-up times and energy losses of the printing machine 10. In that regard, the local reservoir 45 could use the same heat source used by the jet stack of the printhead 12. Thus, a heating plate 58 may be bonded between the jet stack and the local reservoir, as shown in FIG. 2*c*. The small ink volume can be readily brought up to operating temperature using the heating plate.

It is further contemplated that the ink level within the local reservoir 45 can be determined by sensing the state of the membrane 55. Thus, a sensor 60 may be associated with the outer face of the membrane, as shown in FIG. 2*c*. This sensor may be a mechanical or optical sensor that is operable to determine the amount that the membrane has deflected or flexed from its initial, unstressed state 55. The sensor may also include a strain gage capable of measuring strain in the membrane which is a function of the amount that the membrane flexes form its initial state. Data from this sensor 60 may be fed to the controller 32 for use in controlling the operation of the printhead 12.

In the embodiment depicted in FIGS. 2*a-c*, the local reservoir is shown as being generally rectangular in shape. However, other configurations are contemplated to optimize the impact of the resilient membrane. For instance, the front wall 48 may be curved to complement the curvature of the membrane in its flexed state 55'. The reservoir 45 and membrane 55 may be circular in plan view. The membrane itself may be configured to flex uniformly, as shown in FIG. 2*b*, or non-uniformly in order to fully exhaust the reservoir during a printing operation.

Figure 4:
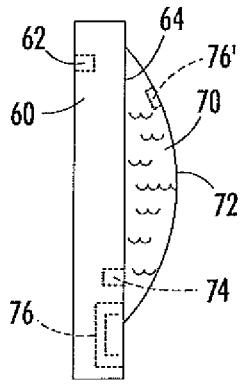
FIG. 4 is a side view of an alternative local reservoir according to the present disclosure mounted to a printhead.

In a further modification, the inlet 57 may be associated with the membrane 55 rather than one of the solid walls, in a manner similar to the inlet 76' shown in FIG. 4 described in more detail herein. In this modification, the inlet should be positioned so as not to interfere with the ability of the membrane to deform to its flexed state 55'.

As explained above, the membrane 55 replaces a solid wall of a reservoir tank. In order to maximize the effect of the membrane, the membrane may replace the larger area wall of the reservoir tank. In addition, it is preferable to situate the membrane where only limited deflection of the membrane is necessary to substantially completely purge the reservoir of ink. Thus, as shown in FIG. 2*a*, the membrane replaces the rear wall of the reservoir, rather than one of the perimeter walls 46.

Figure 3:
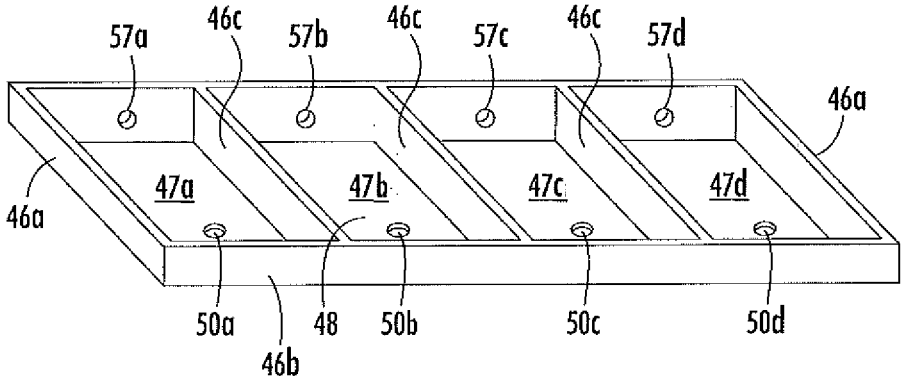
FIG. 3 is a perspective view of a local reservoir for a multi-color printing machine.

In the case of multi-color printing, each ink color can be provided with its own dedicated reservoir. The reservoir 45 may thus be formed as a single plate defining a chamber 47*a-d* for each ink color, all sharing the mating wall 48, as illustrated in FIG. 3. The chambers would be defined by perimeter walls 46*a*, 46*b* as well as interior walls 46*c* separating each chamber. A common resilient flexible membrane, such as the membrane 50, may span all of the chambers provided that the membrane is bonded to the interior walls 46*c* as well as the perimeter walls 46*a-b* so that deflection of the membrane within one chamber does not affect the portion of the membrane covering other chambers. Alternatively, each chamber can be provided with its own membrane bonded to the appropriate walls to close the open face of the corresponding chamber. Each chamber would further be provided with its own one-way inlet 57*a-d*, connected to a corresponding remote ink reservoir 18, and outlet 50*a-d*, connected to an appropriate conduit within the printhead jet stack.

In an alternative embodiment shown in FIG. 4, a modified printhead 60 may have a local reservoir 70 established by a pre-formed complaint membrane 72 affixed directly to the back face 64 of the printhead stack. In this embodiment, the tank configuration of the reservoir is eliminated entirely. In its initial state the membrane 72 defines a cavity that can be filled with an ink charge. As negative pressure is drawn to the inkjet nozzles 62 during a printing operation, the membrane flexes toward the back face 64 of the printhead. The reservoir 70 supplies ink to the printhead through the outlet 74. Ink may be supplied to the reservoir through a one-way conduit 76 formed in the inkjet stack of the printhead. Alternatively, a one-way inlet 76' may be formed in the membrane itself. In either case, the conduit 76 or the inlet 76' operates to allow flow of pressurized ink into but not out of the reservoir, and may incorporate a check valve or similar one-way valve construction, as described above.

In one embodiment, the membrane 72 is a polyimide material that is pre-formed into a generally spherical bubble. The membrane is adhered to the back face 64 of the jet stack to form a fluid-tight seal.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A reservoir for a printhead in an ink jet printing machine, the printhead being formed by a stack of plates that define an ink flowpath to a plurality of inkjet nozzles from at least one printhead inlet at a rear face thereof for flow of ink from the reservoir into the printhead, the reservoir comprising:

a perimeter wall directly bonded to the rear face of the stack of plates forming the printhead to sealably mount the perimeter wall to the printhead and to define a chamber formed by the perimeter wall and the rear face of the printhead only, the chamber being in communication with the printhead inlet and open at one face;

a resilient flexible membrane alone being bonded to said perimeter wall to cover and seal said one open face of the chamber without forming another chamber between the resilient flexible member and another structure contacting the perimeter wall; and an inlet configured for connection to an external ink supply within the inkjet printing machine, the inlet being in communication with said chamber to enable passage of ink from the external ink supply into said chamber.

2. The reservoir of claim 1, further comprising a sensor for detecting deflection of said membrane.

3. The reservoir of claim 1, further comprising an element for applying a force on said resilient flexible membrane away from said chamber.

4. The reservoir of claim 3, wherein said element is a tension spring.

5. A printhead assembly comprising:

an inkjet stack forming a printhead having a plurality of inkjet nozzles that are configured for discharge of liquid ink;

a conduit in communication with said plurality of inkjet nozzles;

a reservoir including;

a perimeter wall directly bonded to a rear face of the inkjet stack of the printhead to sealably mount the perimeter wall to the inkjet stack and to define a chamber formed by the perimeter wall and the rear face of the inkjet stack of the printhead only, the chamber being in communication with the conduit and open at one face;

a resilient flexible membrane alone being bonded to said perimeter wall to cover and seal said one open face of the chamber without forming another chamber between the resilient flexible member and another structure contacting the perimeter wall; and an inlet configured for connection to an external ink supply within the inkjet printing machine, the inlet being in communication with said chamber to enable passage of ink from said external ink supply into said chamber.

6. The printhead assembly of claim 5, further comprising a sensor for detecting deflection of said membrane.

7. The reservoir of claim 5, further comprising an element for applying a force on said resilient flexible membrane away from said chamber.

* * * * *